United States Patent [19]

Donnell

[11] Patent Number: 5,010,803

[45] Date of Patent: Apr. 30, 1991

[54] MICROPHONE MOUNT

[76] Inventor: Kenneth D. Donnell, 672 Norlene, Grass Valley, Calif. 95949

[21] Appl. No.: 268,934

[22] Filed: Nov. 8, 1988

[51] Int. Cl.[5] ..... G10H 3/00; G10H 3/14; G10H 3/18

[52] U.S. Cl. ..... 84/743; 84/723; 84/725; 84/726; 84/727

[58] Field of Search ..... 84/1.04, 1.06, 1.14–1.16, 84/291, 723–727, 730–732, 743; 248/160, 274, 443; 174/72 A, 68.3; 381/118, 169, 188, 205

[56] References Cited

U.S. PATENT DOCUMENTS

| | | | |
|---|---|---|---|
| 630,501 | 8/1899 | Greenfield . | |
| 1,574,297 | 2/1926 | Lilleberg | 174/72 A |
| 2,010,566 | 8/1935 | Schuetz | 381/205 X |
| 2,430,717 | 11/1947 | Hull . | |
| 2,439,551 | 4/1948 | Teikowski | 84/1.04 |
| 3,314,424 | 4/1967 | Berman | 381/169 X |
| 3,509,264 | 4/1970 | Green | 84/1.15 |
| 3,783,201 | 1/1974 | Weiss et al. | 381/169 X |
| 3,935,782 | 2/1976 | O'Brien | 84/1.16 |
| 4,119,007 | 10/1978 | Crigler et al. | 84/1.14 |
| 4,145,944 | 3/1979 | Helpinstill, II | 84/1.15 X |
| 4,168,646 | 9/1979 | May | 84/1.14 |
| 4,168,647 | 9/1979 | Petillo . | |
| 4,351,217 | 9/1982 | Wechter | 84/1.16 |
| 4,404,885 | 9/1983 | Salak . | |
| 4,495,641 | 1/1985 | Vernino . | |
| 4,519,287 | 5/1985 | Naruse | 84/1.16 |
| 4,570,522 | 2/1986 | May | 84/1.14 |
| 4,607,559 | 8/1986 | Armin | 84/1.16 X |
| 4,748,886 | 6/1988 | DeByl | 84/1.14 |

FOREIGN PATENT DOCUMENTS

| | | | |
|---|---|---|---|
| 2177788 | 1/1987 | United Kingdom | 248/160 |

OTHER PUBLICATIONS

SAGA Musical Instruments Catalog Page Referencing an Item Entitled, "DS-30 The Guitar Mic", May 1988.

*Primary Examiner*—A. T. Grimley
*Assistant Examiner*—Matthew S. Smith
*Attorney, Agent, or Firm*—Kilpatrick & Cody

[57] ABSTRACT

A mount for positioning miniature (lavaliere) type microphones, transducers, or similar devices in musical instruments. Such microphones are attached to a flexible shaft which connects directly to an output jack in a manner that requires little or no modification of the instrument. Once installed, no parts of the mechanism are in a position which will interfere with playing the instrument. The flexible shaft permits the player to experiment with positioning the microphone in a variety of locations until the optimum location for sound reproduction is determined.

5 Claims, 19 Drawing Sheets

PRIOR ART

PRIOR ART

PRIOR ART

PRIOR ART

PRIOR ART

MICROPHONE MOUNT

BACKGROUND OF THE INVENTION

1. Field of the Invention

The present invention relates generally to the use of microphones, transducers, or similar devices to amplify the sound of acoustic musical instruments, and particularly, to the mounting of mini- or lavaliere type microphones inside hollow-body stringed musical instruments. Such microphones convert the acoustical vibrations of the instrument into electrical oscillations which are then transmitted to an amplifying device, and finally to a speaker where such oscillations are reconverted into sounds discernable by the human ear. In particular, the present invention involves a mechanism whereby the microphone is mounted inside the instrument.

2. Description of Prior Art

Numerous systems have been devised for the attachment of microphones, transducers, or the like to acoustic musical instruments for the purpose of sound amplification. Hull U.S. Pat. No. 2,430,717 shows a method for mounting a microphone within a cello or string bass by connecting the microphone to the endpin. Salak U.S. Pat. No. 4,404,885 describes an alternative method for connecting a microphone to a string bass. However, both of these designs do not provide a means for moving the microphone in or around the instrument. This is a significant limitation because every individual musical instrument tends to have unique characteristics regarding the optimum location for positioning a microphone. To not permit flexibility in such positioning often limits the quality of sound capable of being reproduced.

Raymond Vernino, in U.S. Pat. No. 4,495,641, teaches a method of attaching a condenser microphone to an instrument by means of a suction cup. Phillip Petillo, in U.S. Pat. No. 4,168,647, shows a method which allows placement of a transducer on a musical instrument by means of a telescoping tube. Both designs permit a limited degree of flexibility in the user's choice of where to locate the microphone or transducer, but provide only for external mounting. Thus, it is possible that the location for the microphone or transducer chosen by the user of such products may impair playing the instrument by being in the vicinity of the hands or other body parts of the player.

Flexible shafts, or goosenecks, have long been employed as a means for mounting microphones, and when so used, do permit a microphone to be positioned in a variety of locations. Most goosenecks are variations of segmented metallic conduit similar to the designs described by E. T. Greenfield in U.S. Pat. No. 630,501. A recent variation from the 1984 catalog of Shure Bros. Inc. shows use of such a gooseneck to mount a microphone. The outer casing of the conduit is sufficiently rigid to support the weight of the microphone, but sufficiently flexible to permit the user to vary the location of the microphone at his or her discretion. The hollow core of the conduit then permits the passage of wires to carry the signal from the microphone to the amplifier and finally the speakers.

Such goosenecks, when mounted on weighted stands, have proven effective in amplifying acoustic musical instruments. However, the player is forced to remain in the immediate vicinity of the microphone for the duration of the performance. That restriction on movement may limit artistic expression and/or be physically uncomfortable for the player.

Attempts to use such goosenecks for mounting a microphone inside an acoustic musical instrument have met with limited success. However, most previous gooseneck designs do not have sufficient movement to position the microphone in the exact location required to obtain the best possible sound reproduction. Even when an appropriate location can be obtained, prior art goosenecks are not sufficiently rigid to support the weight of the microphone, which thus tends to drift to another location and/or impact structural members of the instrument when it is moved or jostled. Such impacts cause undesirable noises which are then amplified.

A further problem encountered when microphones, transducers, or the like are mounted inside musical instruments is presented in providing a means for connecting the signal wires embedded in the sheathed cable from the microphone to the amplifier. The most common solution employed is to install a long panel output jack, such as Switchcraft model no. 151, in the butt of the instrument. A patch cord with ¼" phone plugs and/or audio connectors can then be used to connect the output jack to the amplifier. When the outer flange is properly modified as shown in FIG. 10, it can then function both as an output jack and a button for holding the player's strap.

Use of such a jack is limited, however, by the fact that it must be inserted from the exterior of the instrument. This means that the diameter of the mechanism components can be no greater than the hole in the butt of the instrument, normally 7/16" to ½". This is a significant limitation, as many models of lavaliere microphones or the mechanisms needed to mount such properly are of a greater diameter. A further disadvantage when using a conventional output jack is that the installer must reach inside the instrument with his or her hand and a wrench to install and tighten the threaded locking nut onto the output jack. For persons with large arms and/or instruments with small soundholes, such access may be impossible.

SUMMARY OF THE INVENTION

The present invention overcomes the foregoing and other limitations of prior designs by providing for a novel means of manufacturing a flexible shaft, unique methods for attaching a microphone and an output jack to opposite ends of the shaft, and an efficient means for mounting the entire mechanism inside a guitar or similar musical instrument. A stiff wire is mounted at one end on a modified output jack, and a small microphone is mounted on the other end. Cable electrically connecting the microphone to the jack is coiled around the wire shaft. When mounted inside the instrument, the mechanism permits the microphone to be positioned or repositioned to the exact location needed to achieve the best possible sound reproduction. There will thus be no cords, clamps, or other paraphernalia related to this mechanism located in the vicinity of the user so as to interfere with playing the instrument.

The physical composition of the flexible shaft also permits a much greater degree of movement than has previously been available with goosenecks made of metallic conduit or similar materials. The user may thus experiment with a greater variety of locations in order to achieve the best possible sound reproduction. Furthermore, the flexible shaft of the present invention maintains a rigidity far surpassing conventional gooseneck designs, so that once positioned, the microphone will remain in place and not vibrate against structural members of the instrument.

An additional benefit of the present invention involves its ease of installation and removal. Little or no modifications to the instrument, and few, if any, tools are required for installation. Similarly, the mechanism can be removed permanently or temporarily for adjustment, repair, or relocation into a different instrument. Installation is made from the interior of the instrument, so there are no limitations regarding the size of the mounting mechanism resulting from the need to insert it through a mounting hole. Final anchoring of the mechanism to the instrument is accomplished by tightening a locknut on the exterior of the instrument. The person installing the mechanism thus has no need to manipulate tools or other components deep within the confined interior of the instrument.

When properly mounted within the interior of an instrument, additional benefits result from the fact that the microphone is shielded from external audio signals that would result in unwanted feedback. The player can thus attain a greater volume level of amplified sound with the microphone mounted internally than in previous designs which mount the microphone externally.

DETAILED DESCRIPTION OF THE INVENTION

Figure 11:
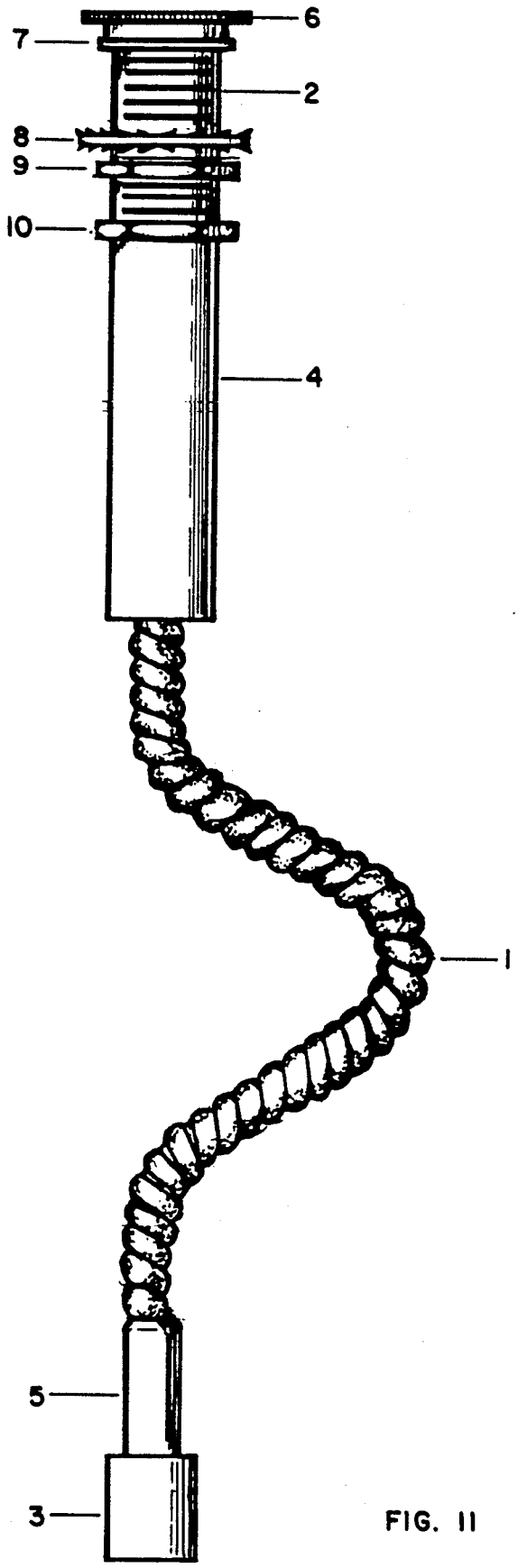
FIG. 11 is a side elevation view of a miniature microphone and the microphone mount of the present invention.

As shown in FIG. 11, the mechanism consists of a microphone 3 mounted on a flexible shaft 1, which is in turn connected to an output jack 2. A threaded, long panel type output jack 2 is shown in this illustration including a strap button nut 6, a flat washer 7, a toothed washer 8, an adjustable hex nut 9, and a fixed hex nut (or stop nut) 10.

Figure 12:
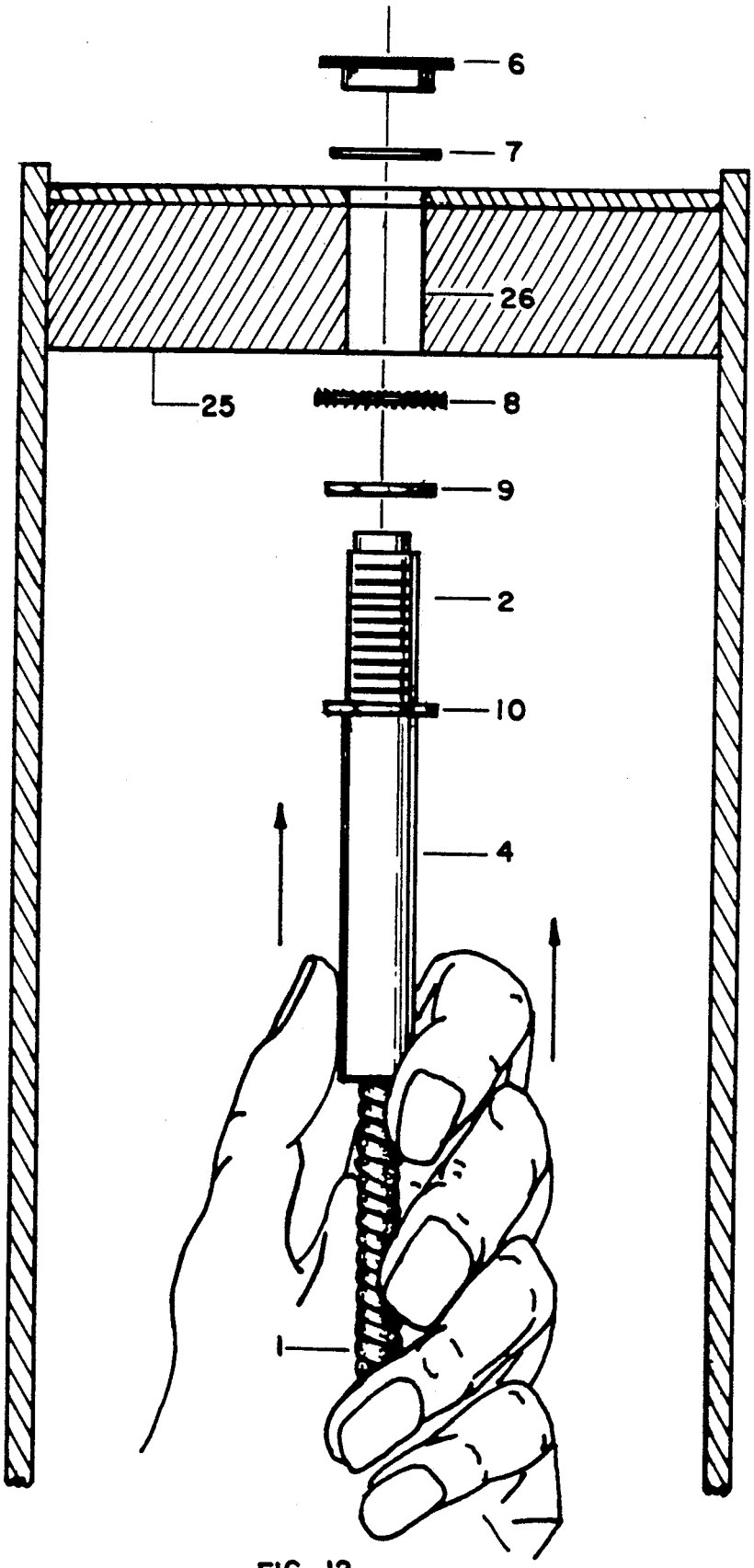
FIG. 12 illustrates installation of the mount of the present invention in the endblock of a guitar.
Figure 13:
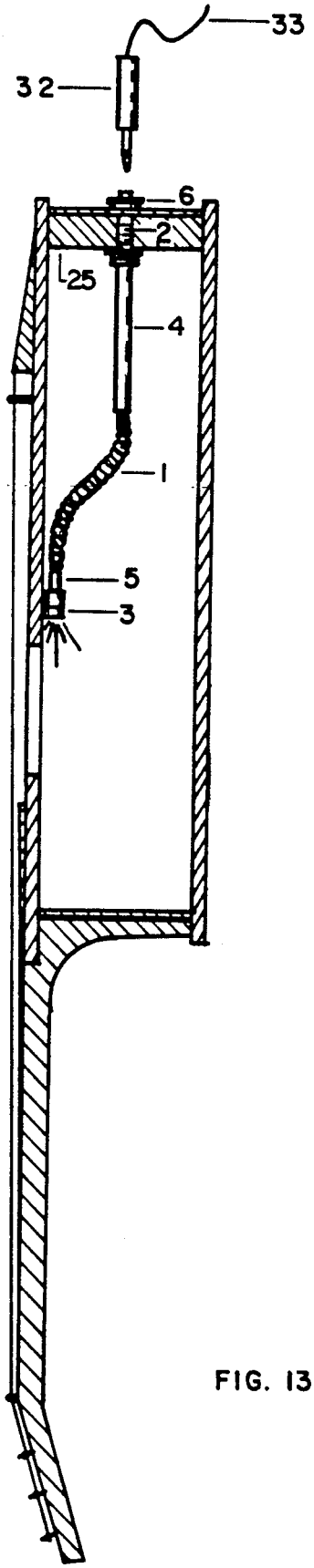
FIG. 13 is a side elevation view of a microphone and mount of the present invention shown in a guitar, which is indicated schematically in section.

As shown in FIG. 12, parts 6 through 10 permit the mechanism to be mounted through an instrument's endblock 25 or other panel up to 1⅛" in thickness. A hole 26 is drilled and/or reamed through the endblock 25 of the instrument, in this instance a guitar. The installer may now insert the mechanism through the soundhole of the instrument, and then insert the output jack through the hole 26 in the endblock 25. If parts 6 through 10 arranged as shown in FIG. 11 and FIG. 12, the installer may thread and tighten the strap button nut 6 with one hand while holding onto the metal tube 4 of the mechanism with his or her other hand. The depth adjusting nut 9 may be loosened or tightened as required by the thickness of the endblock 25. The toothed washer 8 will provide a secure grip while the flat washer 7 will function as a bearing surface in order that the strap button nut 6 may be sufficiently tightened so that the mechanism will not rotate, wobble, or be otherwise insecure. As shown in FIG. 13, the microphone will thus be suspended inside the instrument. At his or her discretion, the user may bend the flexible shaft to adjust the location of the microphone in order to obtain the location which provides the best possible sound reproduction. This may be accomplished by reaching inside the soundhole, or by removing the mechanism, making the necessary adjustments, and then reinstalling the mechanism.

Figure 14:
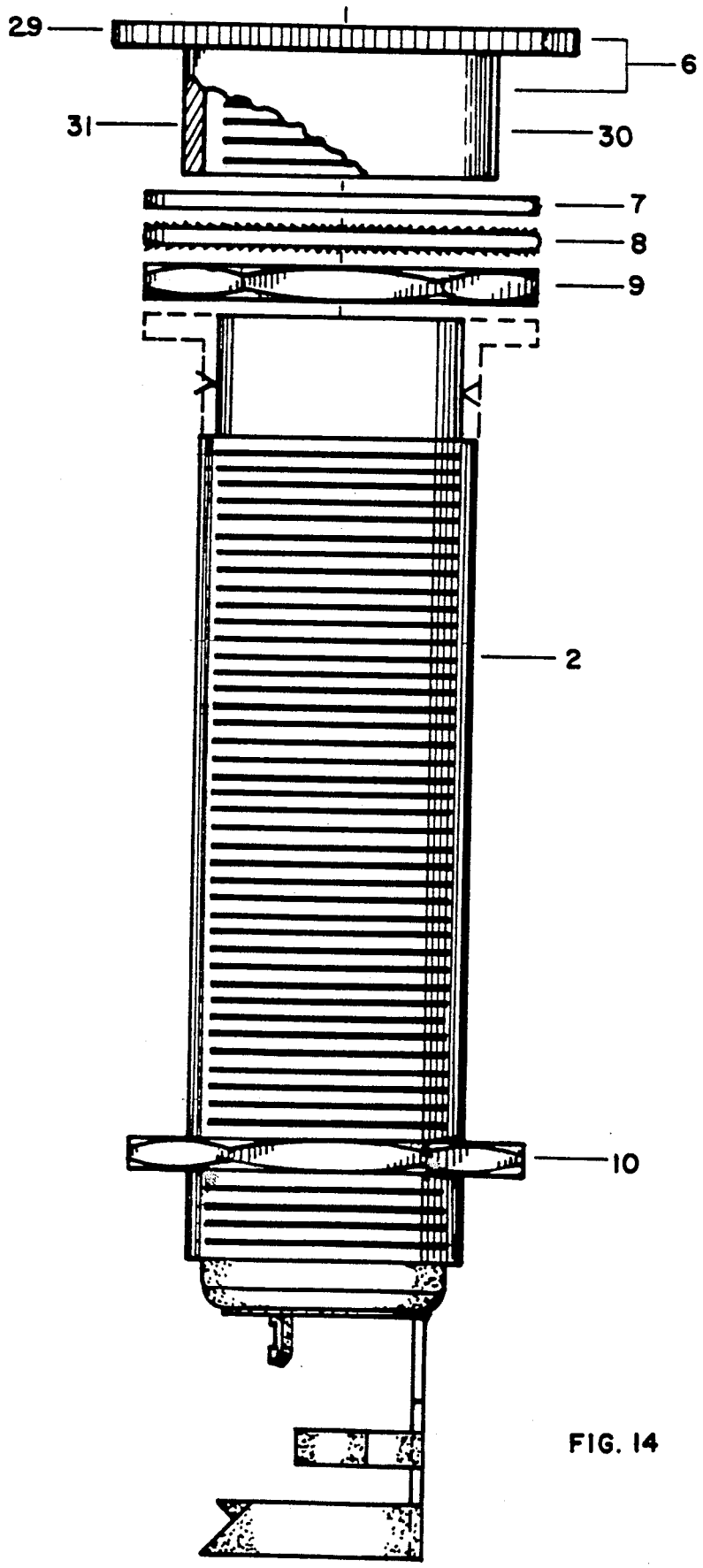
FIG. 14 is a side elevation view of an output jack and end button nut in accordance with the present invention.

Additional detail relating to the construction and mating of the output jack 2 and the strap button nut 6 is shown in FIG. 14, illustrating a Switchcraft 151 long panel jack 2 from which the end flange has been removed by a machine lathe. This permits a mating threaded nut to be installed or removed from either end of the output jack 2. The strap button nut 6 is composed of a knurled flange 29, a barrel with a smooth exterior 30, and a threaded interior 31. The interior threads of the barrel 31 match those of the output jack 2 so that the strap button nut 6 may be threaded onto the output jack 2.

Figure 10:
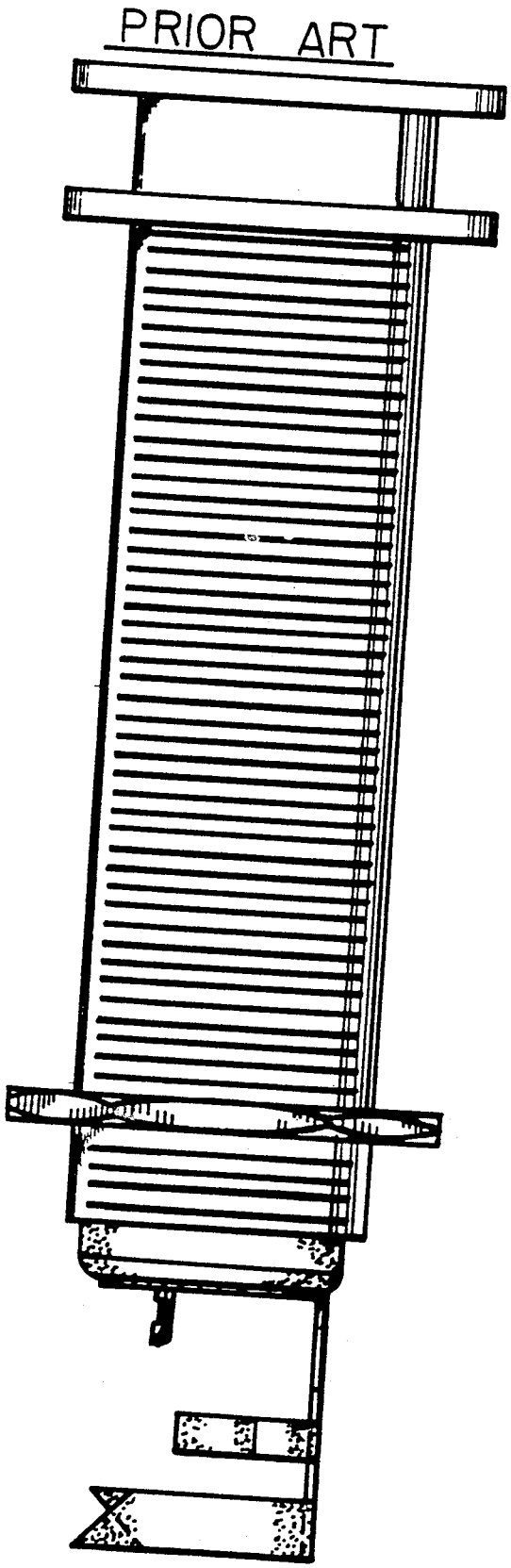

When installed on an instrument with the barrel 30 against the flat washer 7 and the strap button nut 6 threaded onto the output jack 2, the strap button nut 6 will function as an appendage similar to that shown in prior art FIG. 10. A convenient and secure location will thus be provided for the player to attach his or her strap in order to hold the instrument. Furthermore, as shown in FIG. 13, the strap button nut 6 will not interfere with the installation and removal of a ¼" phone plug 32 which will carry the electronic signal of the microphone 3 to an amplifier (not shown) via a sheathed cable 33. Finally, the knurling on the flange 29 will aid in the installation of the mechanism by providing improved grip for the installer to tighten the strap button nut 6.

Figure 15:
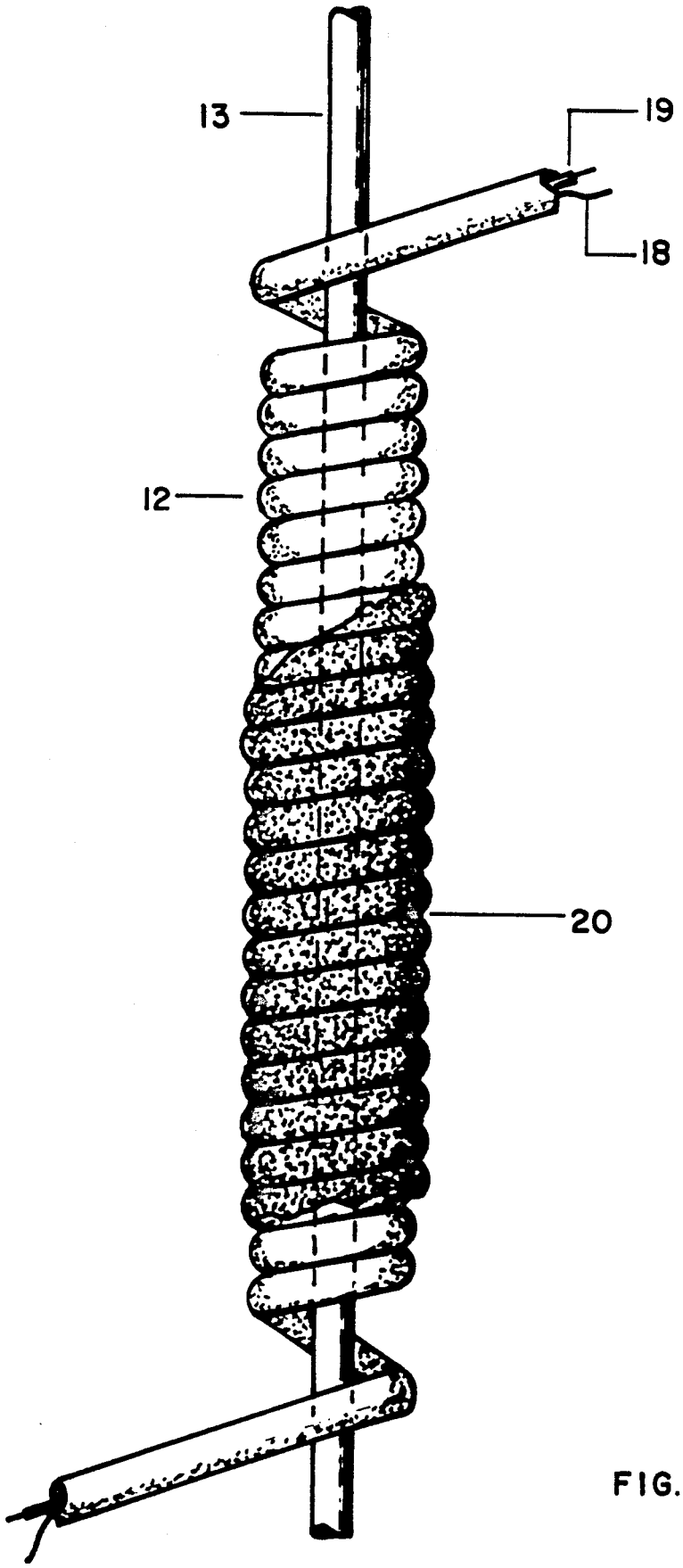
FIG. 15 is a detail of one end of the flexible shaft of the present invention.
Figure 16:
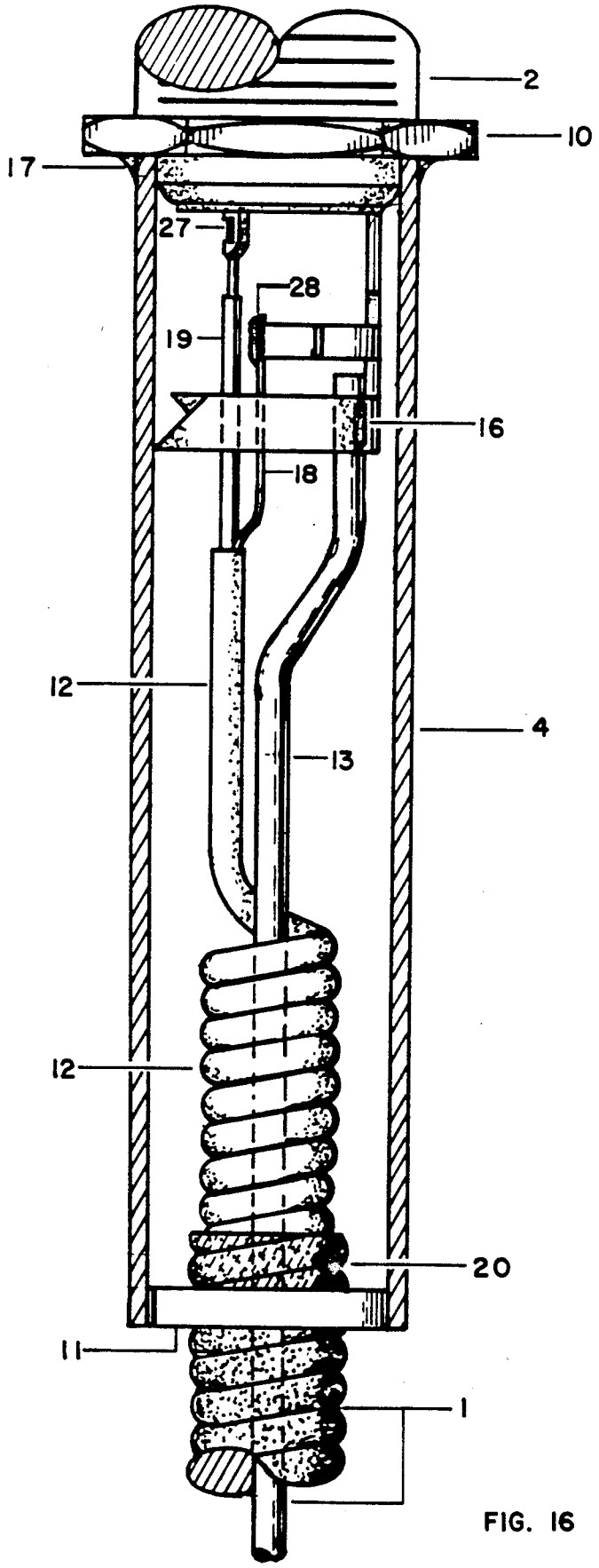
FIG. 16 is a detail of one means of connecting the flexible shaft to the output jack of the present invention.

The construction of the flexible shaft is shown in FIGS. 15 and 16, and is composed of three elements. The first is a rod 13 which may be a solid metal wire or similar flexible material to provide a core. The second is the sheathed cable 12 from the microphone 3 which is tightly wrapped or coiled around the metal wire 13 so that each wrap fits snugly against the previous wrap. The third component is heat shrink rubber or plastic tubing 20 which is reduced around the wrappings of sheathed cable 12. If necessary the sheathed cable 12 may also be affixed to the metal wire 13 by adhesives at the location where the heat shrink tubing 20 terminates. Termination of the heat shrink tubing 20 is detailed by the broken hatched lines in FIG. 16, FIG. 17, FIG. 18 and FIG. 21. The heat shrink tubing 20 holds the sheathed cable 12 in place so that all three components of the flexible shaft 1 may move and function as a single unit. The flexible shaft 1 will then be capable of flexing to the maximum potential of the metal wire 13 or similar material comprising the core. Metal wire 13 of a small diameter and/or soft composition will tend to provide greater ease of movement, but less stability. Metal wire 13 of a greater diameter or hardened composition will be more difficult to flex, but will provide greater stability.

Figure 1:
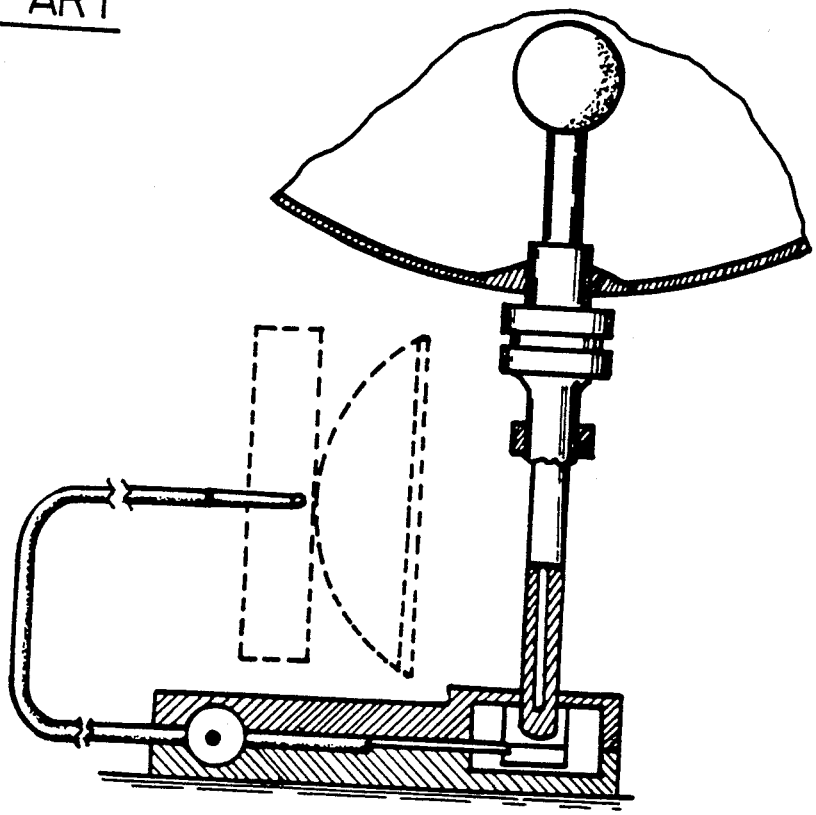
FIGS. 1-10 depict prior art structures.
Figure 2:
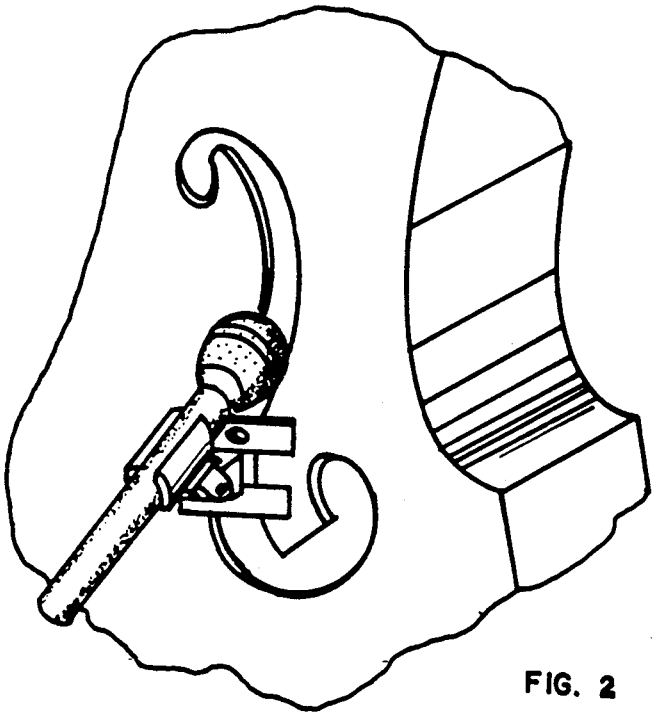
PRIOR ART FIG. 2
Figure 3:
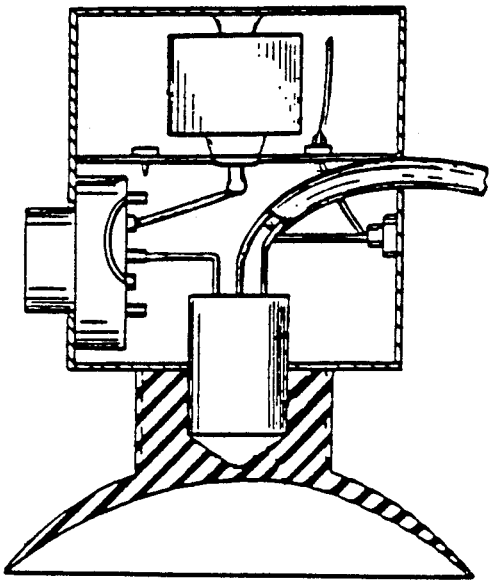
Figure 4:
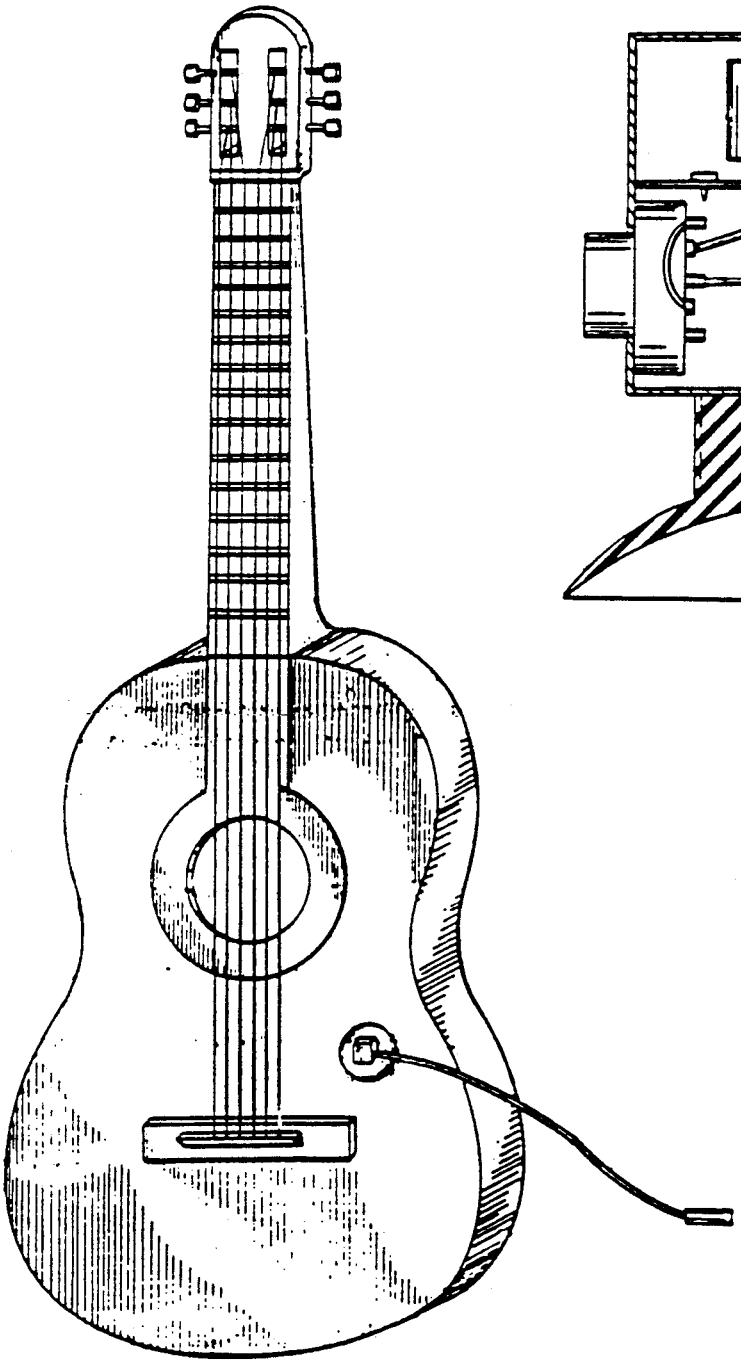
PRIOR ART FIG. 4
Figure 5:
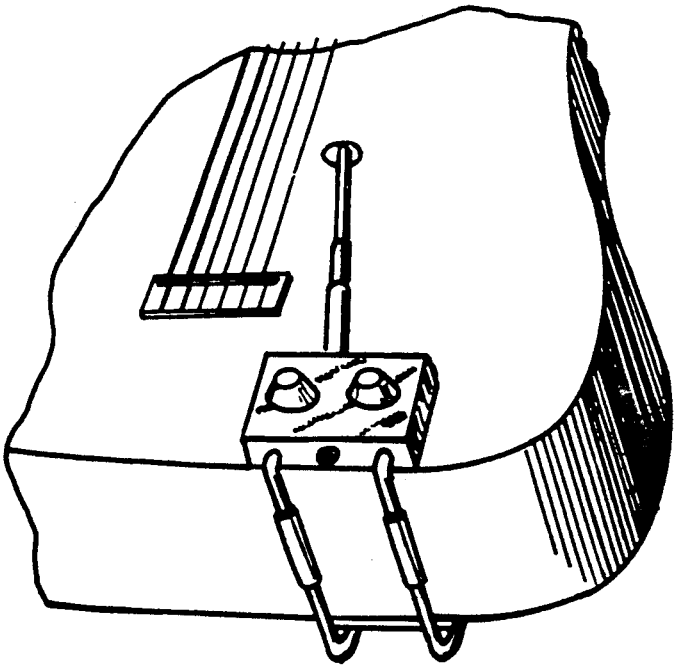
Figure 6:
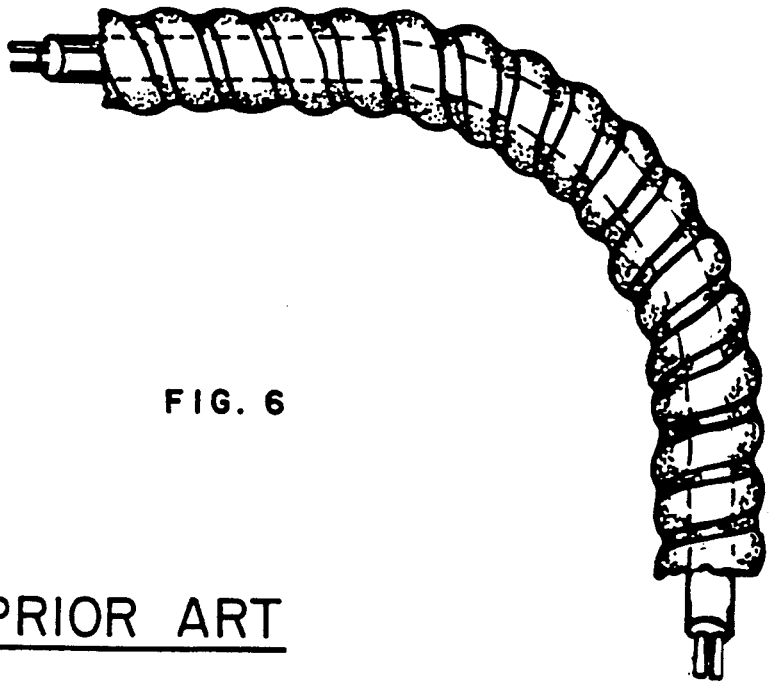
FIG. 6 PRIOR ART
Figure 7:
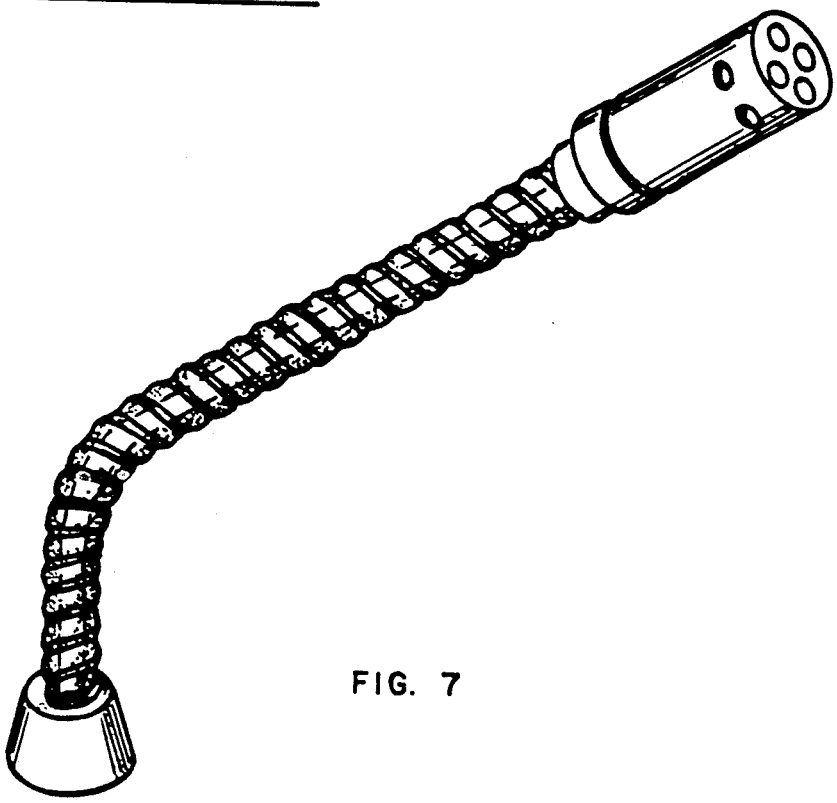
Figure 8:
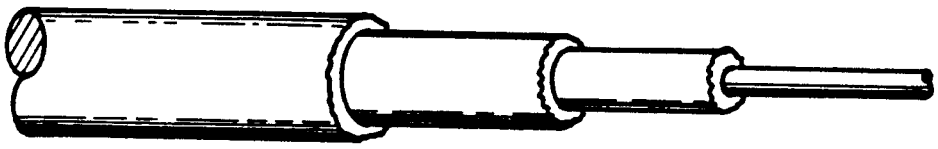
Figure 9:
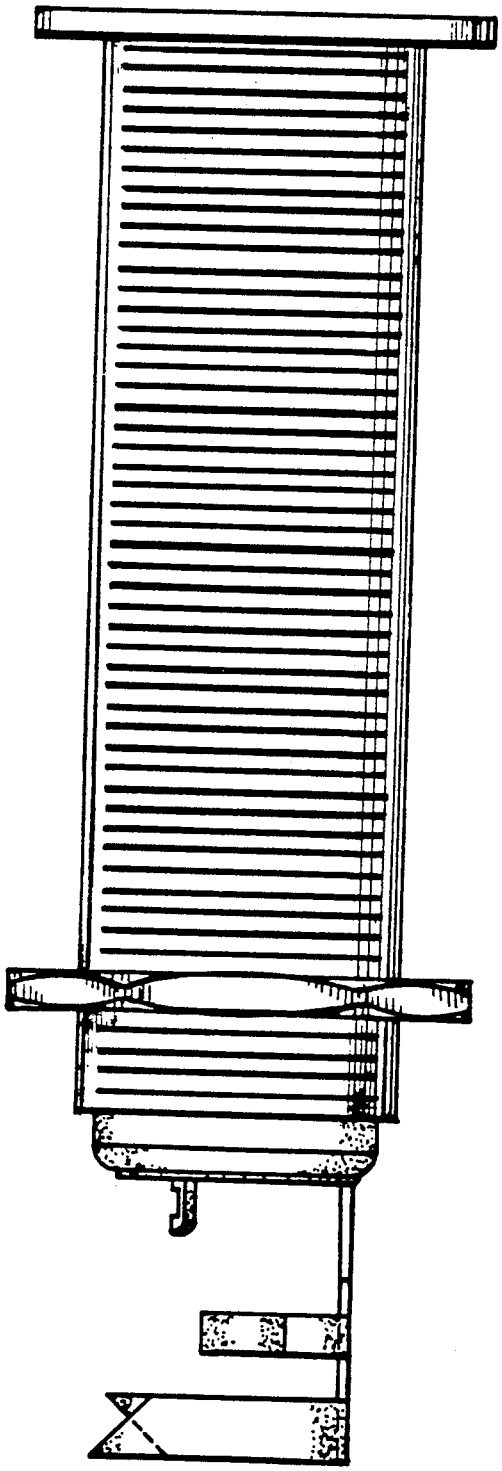

The flexible shaft 1 may also be constructed of certain sheathed cables which contain one or more solid metal wires, as shown in prior art FIG. 8. This drawing depicts a coaxial cable shown on page 78 of Belden's Master Catalog 885. The signal wires from the microphone 3 can be soldered to the wires and/or shielding embedded in the sheathed cable in order to transfer the signal to the output jack 2. Otherwise, the means for mounting and otherwise utilizing such cables as a replacement for the flexible shaft 1 is the same as described above. The solid metallic wires embedded in the sheathed cable will offer a degree of flexibility and stability similar to, but not equal to the flexible shaft 1 described herein.

FIG. 16 shows how the end of the flexible shaft 1 opposite the microphone is connected to the output jack 2. A tube 4 of metal, plastic, or other rigid material is attached to the output jack 2 and the stop nut 10 by a solder joint 17 or adhesives in order to stabilize and secure the various parts of the mechanism. When soldered to the output jack 2, the tube 4 supports the flexible shaft 1 at two locations. The first is at the end of the tube 4 opposite the output jack 2, where a rubber "O" ring 11, or similar resilient material fits around the flexible shaft 1 and inside the tube 4. The "O" ring 11 thus provides support and spacing to the flexible shaft 1. The second location is where the solid metal wire 13 or similar material comprising the core of the flexible shaft 1 is attached to the cable clamp 15 of the output jack 2 by friction, solder, and/or adhesives. The cable clamp is then attached to the tube 4 by a solder joint 16, or adhesives.

FIG. 16 also details the location of the terminals on the output jack 2 where the hot (+) 27 and ground (−) 28 signal wires from the microphone 3 are connected with solder joints. A stereo variation (not shown) of the output jack 2 may also be used in place of the one depicted. Such a stereo output jack is identical to the output jack 2 shown herein except that there are terminals for three signal wires instead of two.

Returning to FIG. 11, the microphone 3 is connected to the flexible shaft 1 via a tube 5 made of metal, plastic, rubber, or similar material. This connection is shown in greater detail in FIG. 17, where the tube 5 is connected to the flexible shaft 1 and the microphone 3 by friction, adhesives, shrink rubber tubing, and/or other methods of bonding. Such a connection may be either permanent or impermanent, as best suits the nature of the microphone 3 and its application.

Figure 17:
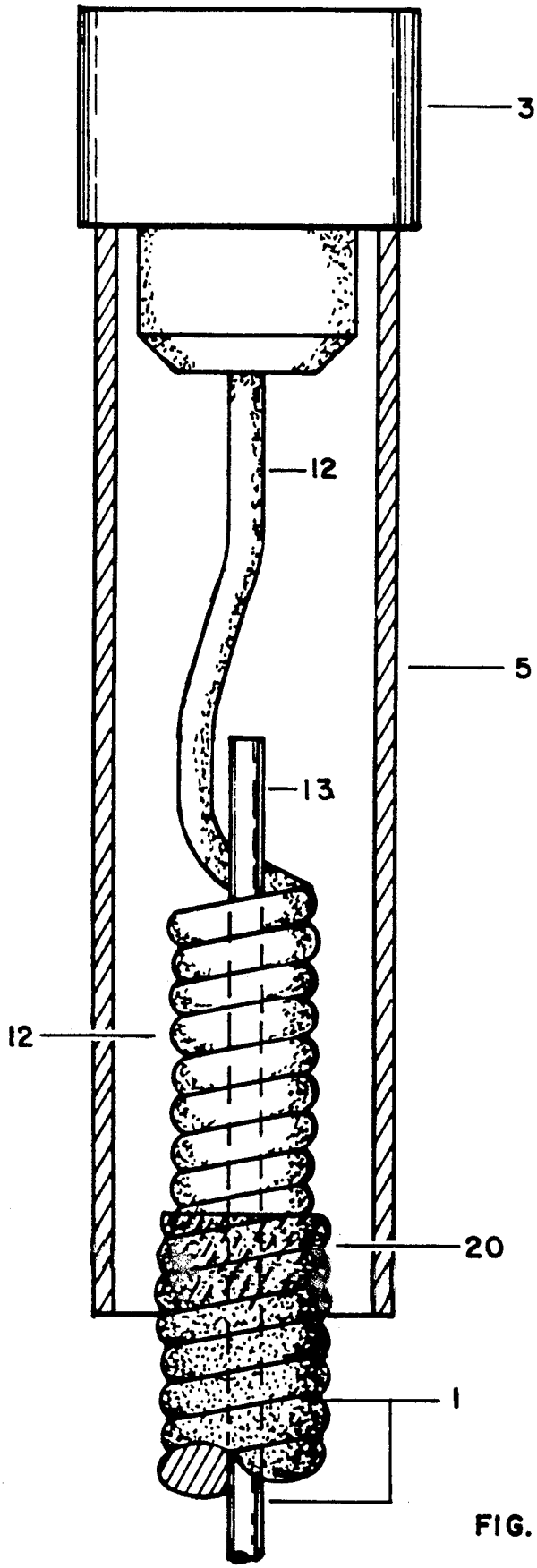
FIGS. 17-21 are details of various means of connecting the microphone end of the flexible shaft of the present invention to microphones.
Figure 18:
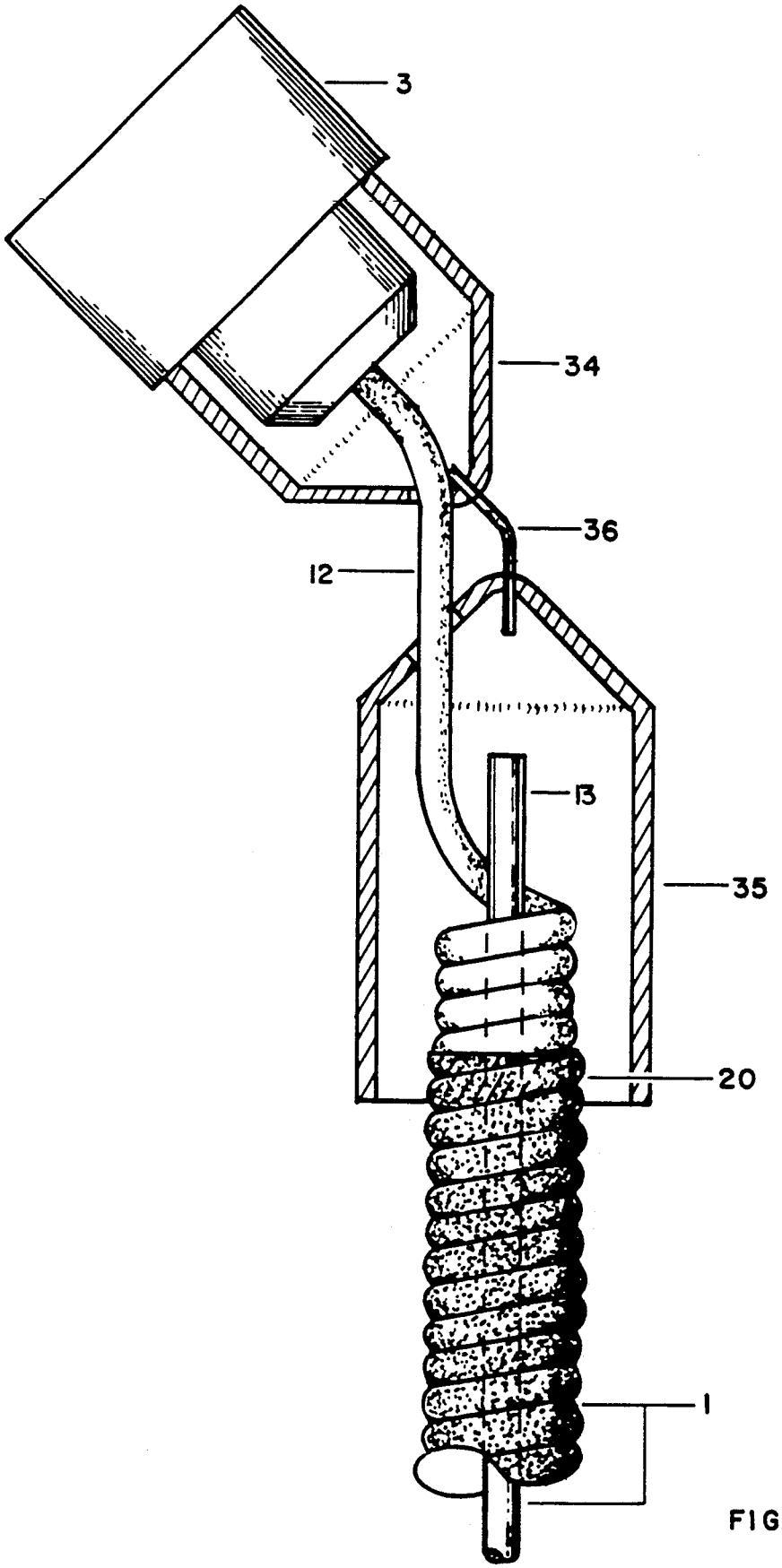
Figure 19:
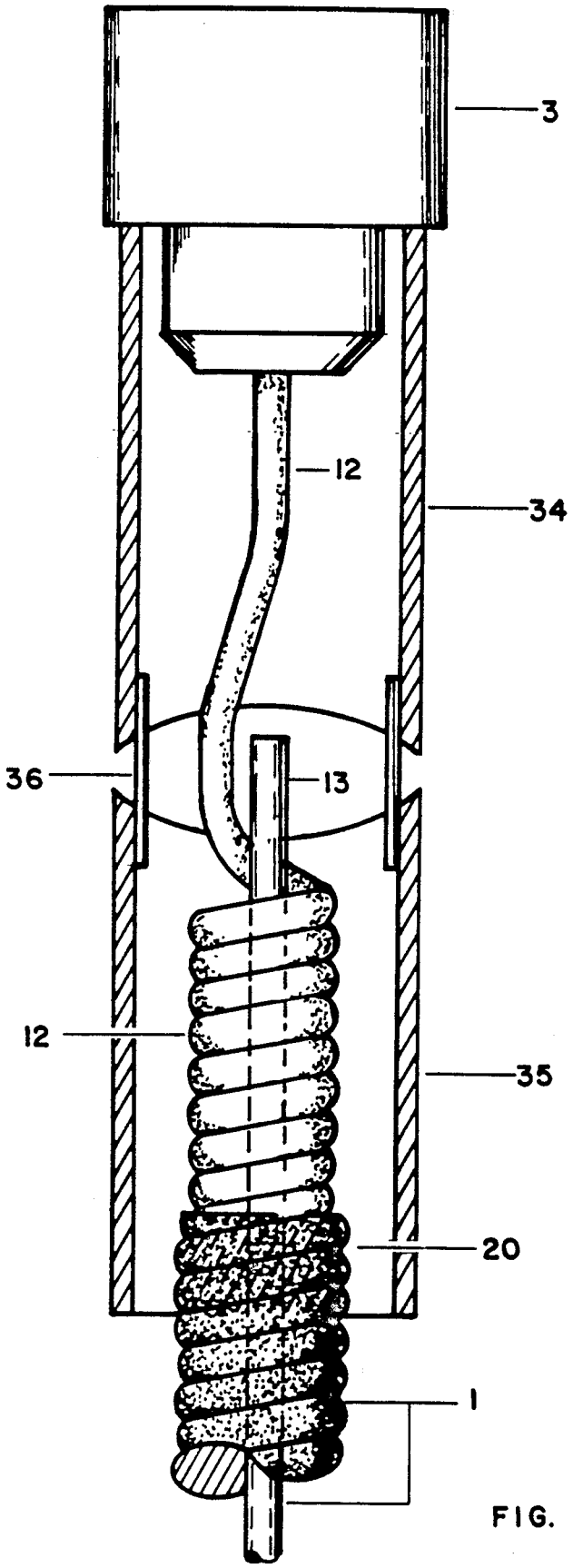

As there is wide variation among the physical characteristics of microphones, there are also a variety of means for mounting the microphone 3 onto the flexible shaft 1. FIG. 11 and FIG. 17 show connection being made by a tube 5, which in this instance is straight, but could also be either bent or curved. A similar method providing greater options to the user is shown in FIG. 18 and FIG. 19 where the microphone 3 and flexible shaft 1 are mounted in separate sections of tube (34 and 35, respectively) that are connected by flexible pins 36, hinges, rivets, or other flexible devices. The user of the microphone can thus variate the angle at which the microphone may face away from the flexible shaft.

Figure 20:
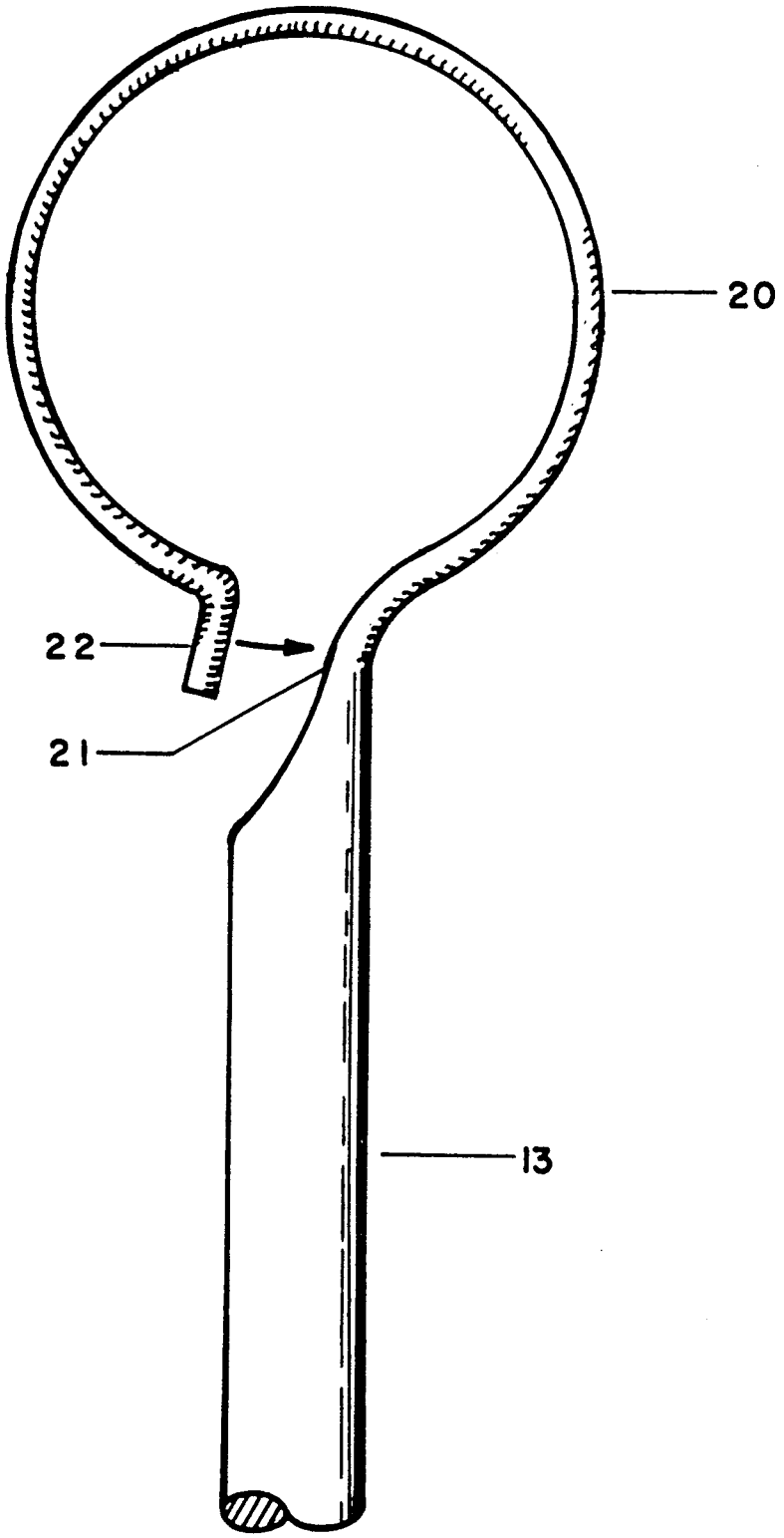
Figure 21:
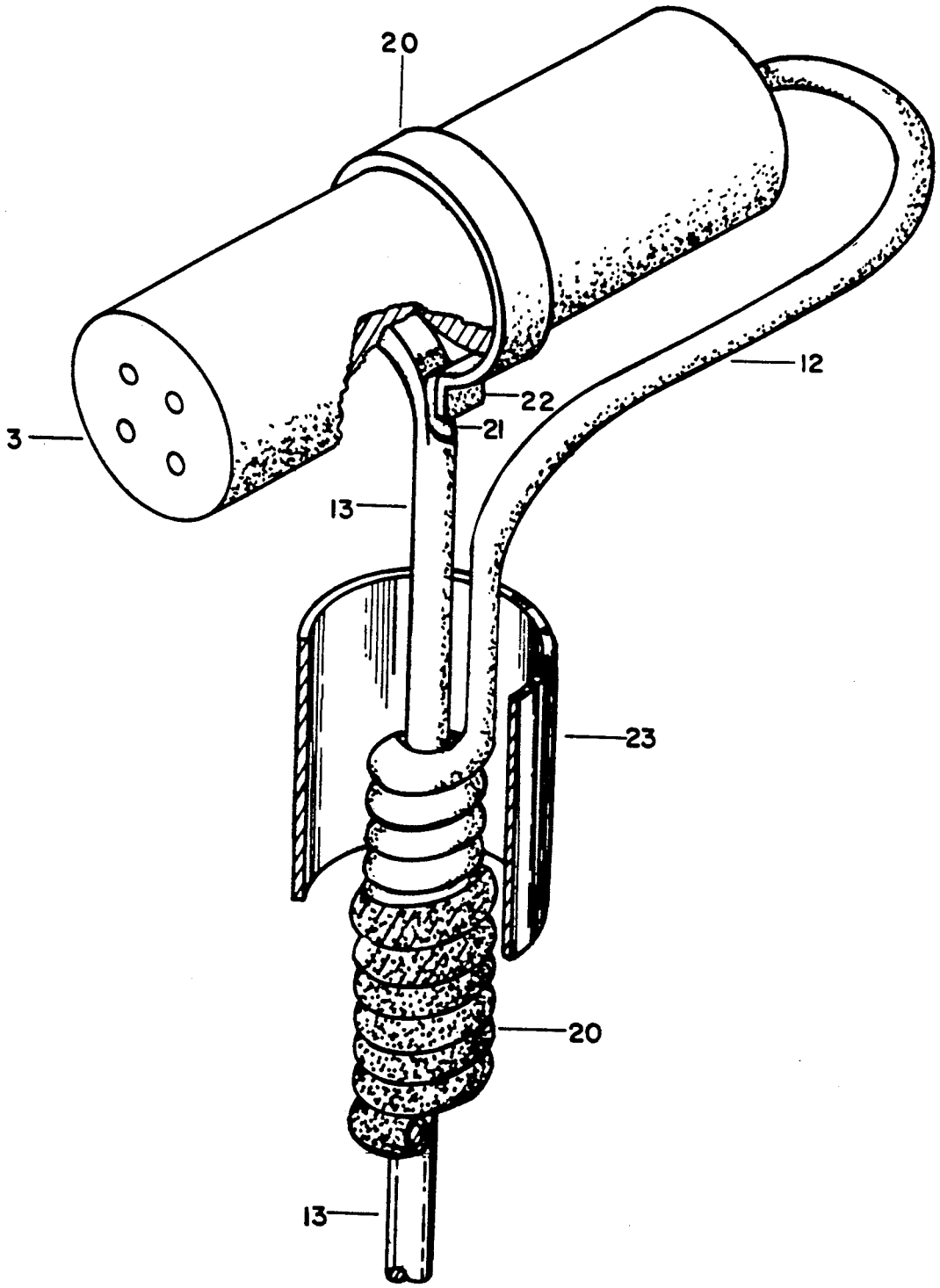

Yet another variation for mounting the microphone 3 onto the flexible shaft 1 is detailed in FIG. 20 and FIG. 21. FIG. 20 shows how the solid metal wire 13 or other material that comprises the core of the flexible shaft 1 is flattened at its end and fashioned into a loop by means of a solder joint 21, or adhesives. FIG. 21 shows the microphone mounted into this loop via friction and/or adhesives. The sheathed cable 12 emerges from the microphone 3 and connects to the flexible shaft inside a tube 23 of metal, plastic, rubber, or similar material. This tube 23 is connected to the flexible shaft 1 with friction, adhesives, and/or shrink tubing.

Figure 22:
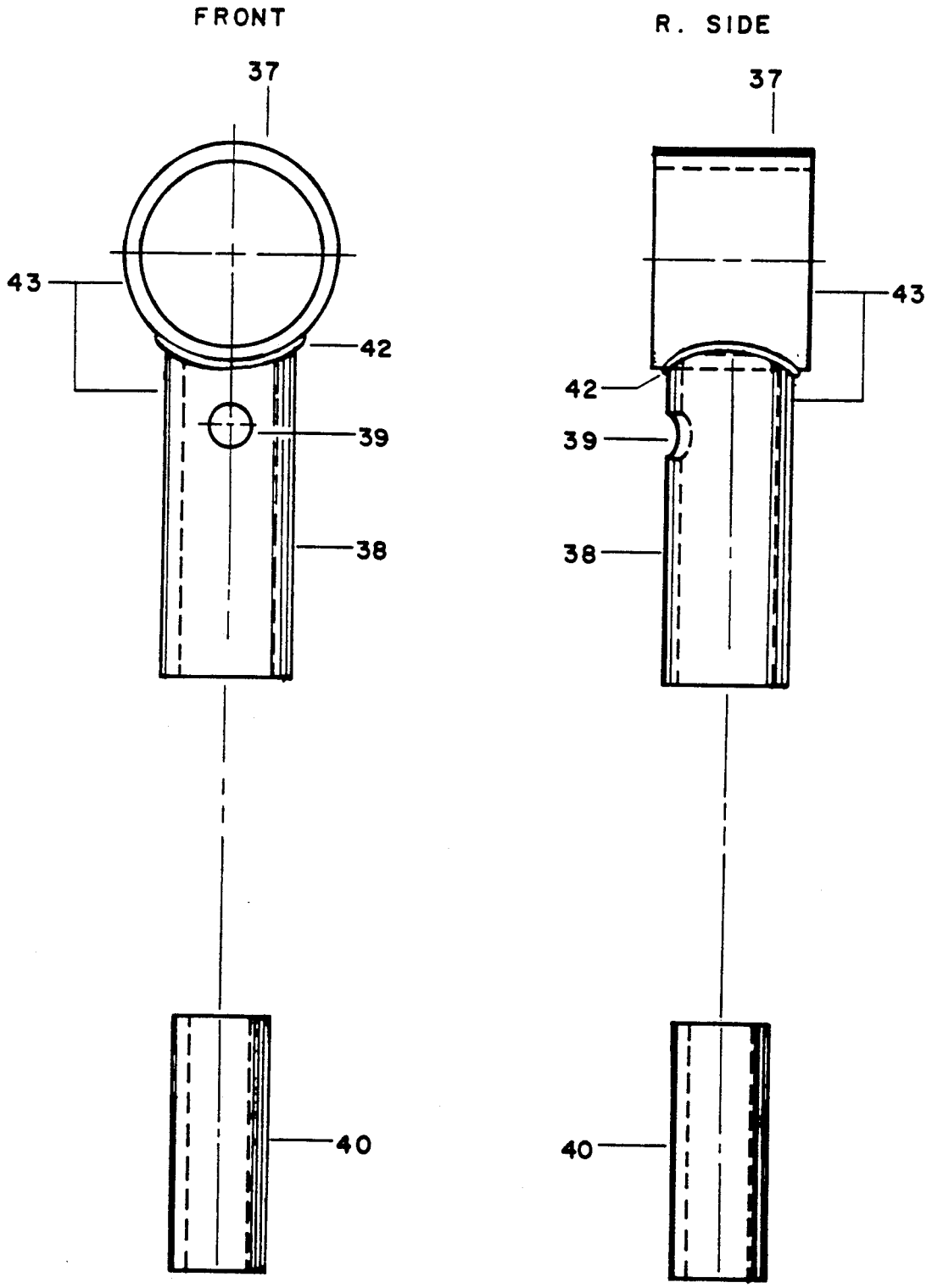

A variation similar to that mentioned above is shown in FIG. 22 and FIG. 23. FIG. 22 shows a microphone support 43 which is composed of a length of metal tubing 37, with a second length of tubing 38 cut and joined at an angle of ninety degrees via a solder joint 42. A third section of tubing 40 is separate, but capable of telescoping into tube 38.

Figure 23:
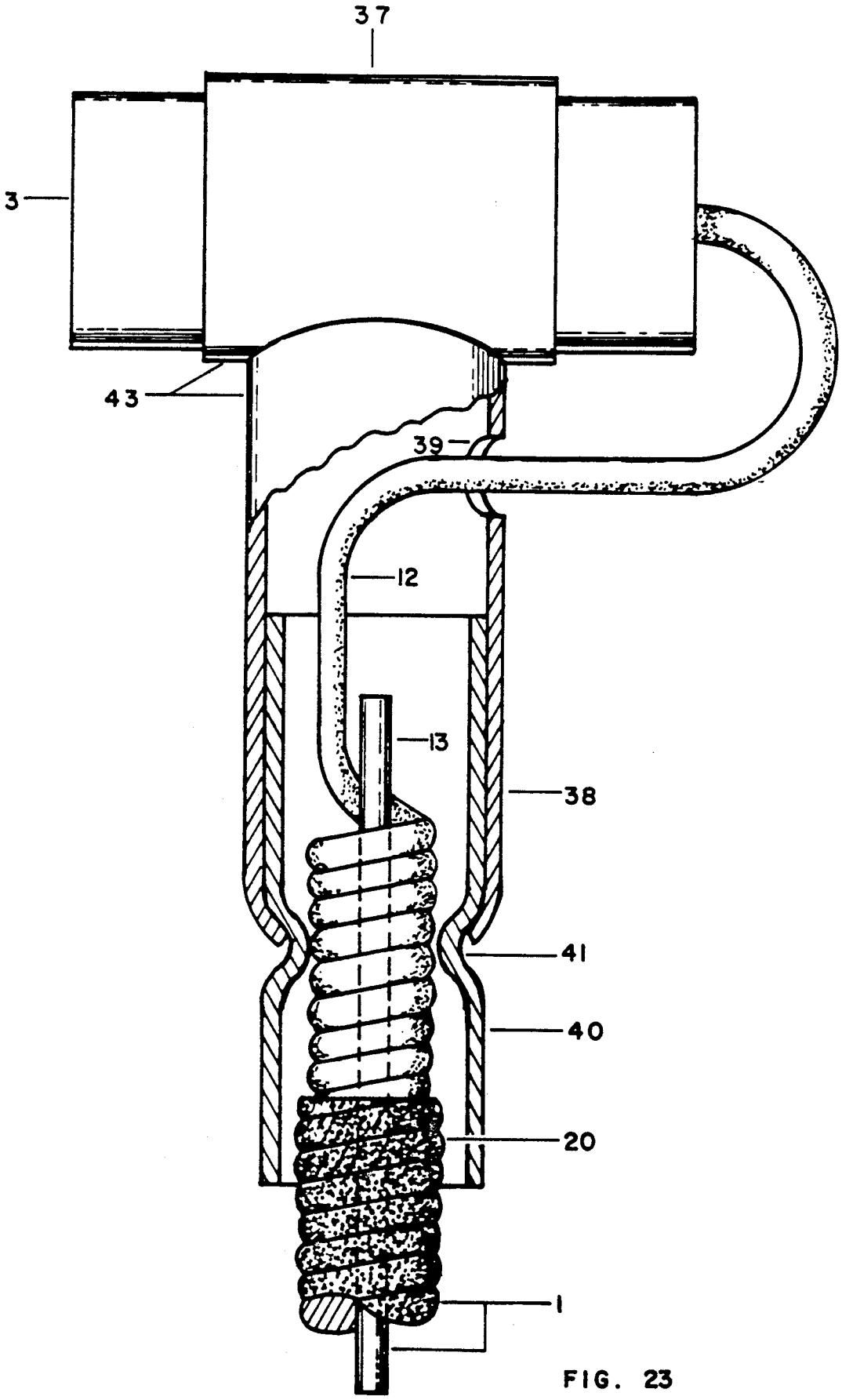

FIG. 23 shows how the flexible shaft 1 mounts into tube 40 (shown by broken lines) by friction and/or adhesives in a manner identical to that depicted in FIG. 17, FIG. 18, FIG. 19, and FIG. 21. The microphone 3 is affixed inside tube 37 of the microphone support 43 with adhesives, and its sheathed cable travels to the flexible shaft 1 through a hole 39 drilled into tube 38.

The microphone adapter 43, along with the microphone 3, are fitted to the flexible shaft 1 by tube 38 and tube 40 being telescoped together. The microphone adapter 43 and the flexible shaft are then permanently joined by a concentric, circular crimp made in both tube 38 and tube 40. Tube 38 and tube 40 may not now be pulled part, yet each tube may rotate inside or outside of the other. Thus, the microphone 3 and the flexible shaft 1 are firmly connected, but the microphone can rotate independently of the flexible shaft 1.

I claim:

1. An adjustable microphone assembly for mounting inside a musical instrument, comprising:

a. a miniature microphone;

b. an output jack comprising a threaded barrel having two ends, which barrel may receive a threaded nut from either end for permitting insertion of the jack from within the instrument into an opening in the wall of the instrument and allow communication between the inside and the outside of the instrument;

c. a threaded strap button nut for securing the output jack in the instrument by threading the nut onto the output jack from outside the instrument against a flat bearing surface and for receiving one end of an instrument supporting strap;

d. a bendable rod mechanically and electrically connectable to the output jack at one end of the rod and to the microphone at the other end, for electrically connecting the microphone to the output jack and supporting it in a desired position within the instrument;

e. a sheathed cable coiled tightly around the rod and connectable at one end to the output jack and at the other end to the microphone; and f. shrink wrap tubing surrounding and mechanically connecting adjacent portions of the coiled sheathed cable and output jack.

2. An apparatus for mounting a transducer within an instrument having a body defining a sound hole through which the transducer can pass and an opening through which the transducer cannot pass, comprising:

a. an output jack which may be mounted from within the instrument into the opening in the body of the instrument to communicate electrical signals between the inside and outside of the instrument; and b. an elongated, multi-component shaft mechanically and electrically connectable to the transducer and the jack for supporting and positioning the transducer at any desired location within the body of the instrument, which shaft components are bound together to prevent movement of one component apart from the other components and comprise:

i. a pliable rod for supporting the transducer;

ii. a sheathed electrical cable coiled around the rod for carrying an electrical signal; and iii. shrink wrap tubing surrounding the rod and cable, for binding the rod and cable together.

3. An apparatus for mounting a microphone inside a musical instrument, comprising:

a. an output jack for mounting in the instrument to communicate between the inside and the outside of the instrument; and b. an elongated shaft mechanically and electrically connectable to the microphone and the output jack, which shaft is substantially uniformly pliable throughout its length for supporting and positioning the microphone at any desired location within the instrument and comprises:

i. a pliable rod;

ii. a sheathed electrical cable coiled around the rod for carrying an electrical signal; and iii. shrink wrap tubing surrounding the rod and cable, for binding the rod and cable together and preventing movement of the cable apart from the rod.

4. The mounting apparatus of claim 3, wherein the output jack has a threaded barrel having two ends and the barrel may receive a threaded nut from either end, for permitting insertion of the jack from within the instrument into an opening in a wall of the instrument.

5. The mounting apparatus of claim 3, further comprising a threaded strap button nut for securing the output jack in the instrument by threading the nut onto the jack from the outside of the instrument and for receiving one end of an instrument supporting strap.

* * * * *